US006171118B1

(12) United States Patent
Witkowski et al.

(10) Patent No.: US 6,171,118 B1
(45) Date of Patent: Jan. 9, 2001

(54) CORD PLUG WITH PROTECTOR CAP

(75) Inventors: Ireneusz Witkowski; Claudio Zubin, both of Winnipeg (CA)

(73) Assignee: Phillips & Temro Industries Ltd.(CA)

( * ) Notice: Under 35 U.S.C. 154(b), the term of this patent shall be extended for 0 days.

(21) Appl. No.: 09/274,735

(22) Filed: Mar. 23, 1999

(51) Int. Cl.[7] ..... H01R 13/44
(52) U.S. Cl. ..... 439/142
(58) Field of Search ..... 439/142, 143, 439/134, 136, 148, 149

(56) References Cited

U.S. PATENT DOCUMENTS

| | | | | |
|---|---|---|---|---|
| 1,551,267 | | 8/1925 | Schenck et al. . | |
| 3,195,095 | * | 7/1965 | Field | 439/142 |
| 3,270,267 | | 8/1966 | Nolte . | |
| 3,494,657 | | 2/1970 | Tantlinger . | |
| 3,497,707 | | 2/1970 | Stewart . | |
| 3,641,472 | | 2/1972 | Phillips . | |
| 4,052,655 | | 10/1977 | Vizza . | |
| 4,067,635 | | 1/1978 | Solberg . | |
| 4,106,834 | | 8/1978 | Horowitz . | |
| 4,712,861 | * | 12/1987 | Lukas et al. | 439/44 R |
| 4,829,223 | | 5/1989 | Broberg et al. . | |
| 4,917,625 | | 4/1990 | Haile . | |
| 4,940,423 | | 7/1990 | Aihara et al. . | |
| 5,080,603 | | 1/1992 | Mouissie . | |
| 5,124,506 | | 6/1992 | Briggs et al. . | |
| 5,382,179 | | 1/1995 | Noschese . | |
| 5,538,439 | | 7/1996 | Fell et al. . | |
| 5,588,853 | | 12/1996 | Anthony . | |
| 5,885,098 | | 3/1999 | Witkowski . | |

FOREIGN PATENT DOCUMENTS

| | | |
|---|---|---|
| 25 16 596 | 10/1976 | (DE) . |
| 37 15358 A1 | 11/1988 | (DE) . |
| WO 96/36093 | 11/1996 | (WO) . |

OTHER PUBLICATIONS

Calix brochure dated Apr. 11, 1996 (2 sheets).

* cited by examiner

*Primary Examiner*—Khiem Nguyen
*Assistant Examiner*—J. F. Duverne
(74) *Attorney, Agent, or Firm*—Harness, Dickey & Pierce, P.L.C.

(57) ABSTRACT

The present invention includes a plug assembly and cord set for use with an automobile accessory that is mounted to an automobile body. The plug assembly includes a plug body having a contact surface, electrical contacts coupled to the plug body and projecting from the contact surface, and a protector cap that accommodates the contacts and protects the contacts from the surrounding environment when the protector cap is in its closed position. The protector cap includes a contact cavity and a cap seal surface surrounding the contact cavity at an open end thereof. The protector cap is coupled to the plug body for pivotal movement between an open position and a closed position wherein the electrical contacts are disposed within the contact cavity and the cap seal surface engages the contact surface to seal the contact cavity when the protector cap is in its closed position. The present invention further includes a mounting assembly for connecting the plug to the vehicle body wherein the mounting assembly includes a mounting bracket having an aperture to accommodate the plug body and the plug body includes a coupling tab having a first end integral with the plug body and a second end movable between an engaged position and a retractive position. When the coupling tab is in its engaged position the tab engages a mounting bracket to couple the plug body to the mounting bracket.

12 Claims, 3 Drawing Sheets

CORD PLUG WITH PROTECTOR CAP

BACKGROUND OF THE INVENTION

1. Technical Field

The present invention relates generally to electrically powered accessories for motor vehicles and, more particularly, to a cord set for such electrical powered accessories.

2. Discussion

Various electrically powered devices are designed for use with vehicles including automobiles, light-duty trucks, and heavy-duty vehicles. These devices, including cold weather starting devices such as radiant heaters, engine block heaters, fluid heaters, battery warmers, and the like, are generally fixed to the automobile body and operationally connected to an appropriate component of the vehicle engine. A factor in the sales and use of these devices is the simplicity with which the device can be electrically connected to the power source. To address this ease of use concern, cord sets have been developed that include a receptacle located on the vehicle body for mounting power cords that are connectable to the electrically powered device. The power cords terminate at a male or female plug that is coupled to the receptacle. The other of the male or female plug is selectively disposable in the receptacle to cooperate with the first plug, and electrically connect the device to the power source.

While manufacturers have provided cord sets for selectively connecting electrically powered automotive accessories to an external power source, they have failed to address a variety of operational and assembly concerns particularly with respect to mounting ease and protection of the contacts from the environment. Accordingly, a need still exists for a simple and robust cord set that may be easily installed in a variety of applications. This need manifests itself most specifically in the desire for manufacturing simplicity, cost savings, and operational simplicity.

A further concern with respect to cord sets designed for use with automobiles is the harsh environment to which the cord set is subjected during use. Specifically, it is necessary to maintain the electrical contacts clean and free from environmental elements when the male and female plugs of the cord set are not connected to one another.

In order to prevent dirt, ice, snow, and other environmental elements from negatively impacting the performance of the cord set and, particularly, the electrical connection between the male and female plugs, the prior art commonly provides a receptacle or housing. One of the cords in the set has a first end electrically connected to the electrically powered apparatus and a second end with the male plug. The male plug is received into one end of the housing and securely and sealingly coupled thereto. The housing generally includes a cover for sealing the first end of the housing while the interface between the plug and housing seals the rear side of the housing. As a result, the housing or receptacle requires two sealing interfaces. Each of the interfaces must effectively seal the contacts from environmental elements.

In addition to the multiple sealing interfaces, prior art cord sets required plug and housing configurations different from the standard configuration of electrical extension cords. Commonly, the plugs and receptacles are either circular or rectangular in cross-section to provide interfaces that can be more readily sealed. However, these configurations prevent the use of standard electrical extension cords with the cord sets.

In view of the above, it would be desirable to manufacture a cord set for an electrically powered automotive device that is sufficiently small in size to more readily fit in the extremely tight space constraint within the automotive market, that protects the electrical contacts of the plug automatically upon removal of the mating extension cord, effectively isolates the plug contacts from the surrounding environment, and that can accept standard extension cords.

It is further desirable in view of the above discussion to include a mounting mechanism for connecting the compact plug protector to a fixed point that is on or connectable to the vehicle. Such fixed point mounting plugs are more aesthetically pleasing, eliminate potential for customer misrouting, reduces the strain on the plug/wire interface, are more effectively secured to the vehicles so as to eliminate dangling and associated damage during vehicle motion, simplify power connections, and allow the use of simpler wire harnesses by terminating the plug at the vehicle bumper rather than requiring routing through the vehicle hood.

SUMMARY OF THE INVENTION

In view of the above, it is an object of the present invention to provide a cord set that includes a sealed cavity about the electrical contacts extending from the plug that is mounted to the vehicle body without the need for an additional receptacle or housing within which the plug is disposed.

It is a further object of the present invention to provide a protector cap and contact surface configuration that allows free movement of the protector cap between its open and closed positions while effectively sealing the contact cavity from the surrounding environment when the protector cap is in its closed position.

Still another object of the present invention is to provide a mounting mechanism for connecting the plug to the vehicle body which allows the plug to be mounted within tight space constraints.

Accordingly, the present invention provides a plug assembly and cord set for use with an automobile accessory that is mounted to an automobile body. More particularly, the plug assembly includes a plug body having a contact surface, electrical contacts coupled to the plug body and projecting from the contact surface, and a protector cap that accommodates the contacts and protects the contacts from the surrounding environment when the protector cap is in its closed position. The protector cap includes a contact cavity and a cap seal surface surrounding the contact cavity at an open end thereof. The protector cap is coupled to the plug body for pivotal movement between an open position and a closed position wherein the electrical contacts are disposed within the contact cavity and the cap seal surface engages the contact surface to seal the contact cavity when the protector cap is in its closed position. The present invention further includes a mounting assembly for connecting the plug to the vehicle body wherein the mounting assembly includes a mounting bracket having an aperture to accommodate the plug body and the plug body includes a coupling tab having a first and integral with the plug body and a second end movable between an engaged position and a retractive position. When the coupling tab is in its engaged position the tab engages a mounting bracket to couple the plug body to the mounting bracket.

BRIEF DESCRIPTION OF THE DRAWINGS

Other objects and advantages of the invention will become apparent to one skilled in the art upon reading the following specification and subjoined claims and upon reference to the drawings in which:

DETAILED DESCRIPTION

Figure 1:
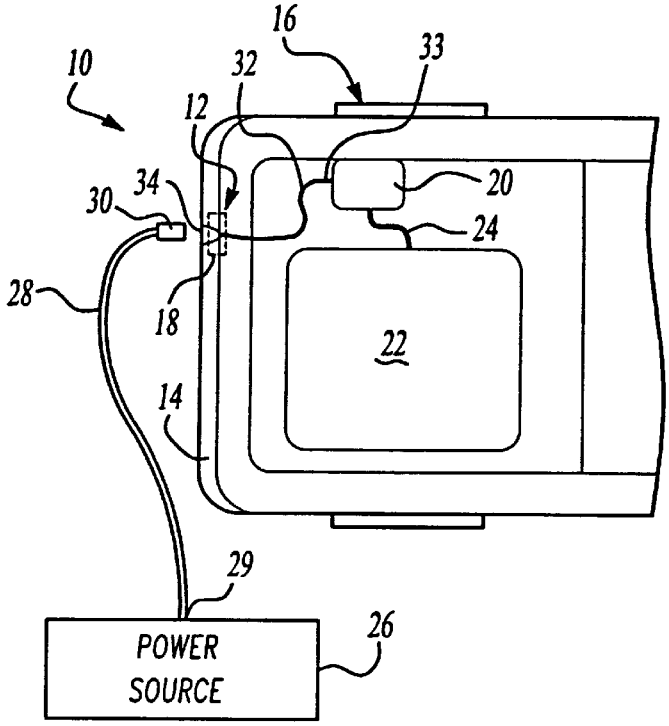
FIG. 1 is a top plan view of a portion of an automobile schematically illustrating the cord set of the present invention.
Figure 2:
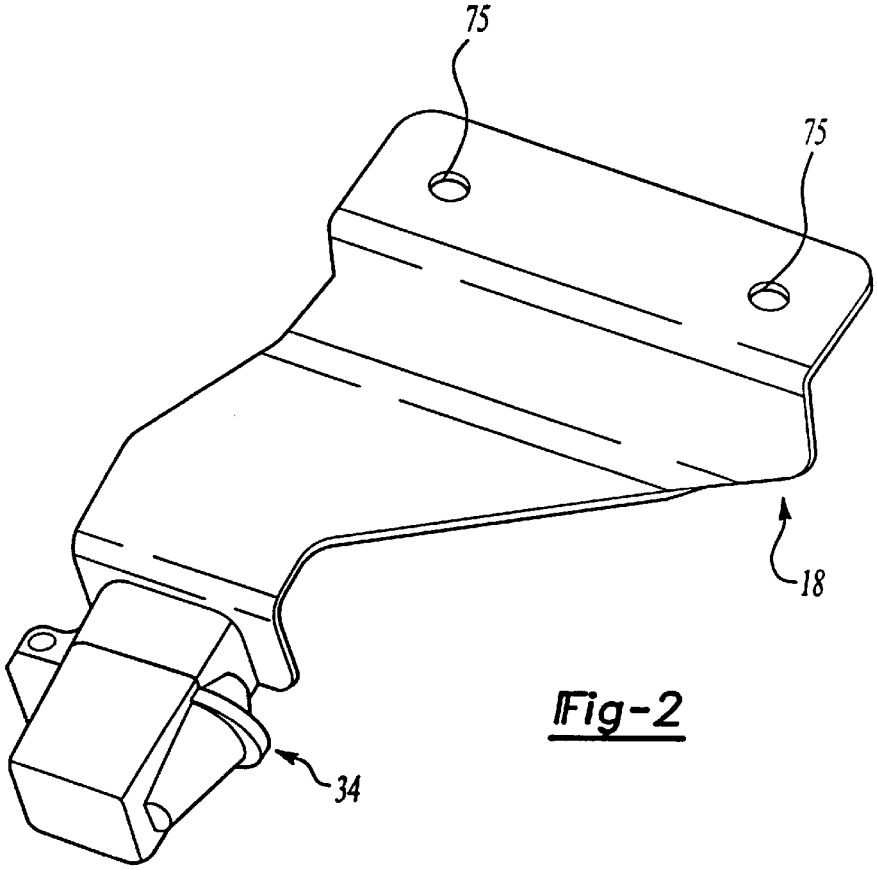
FIG. 2 is an upper perspective view of the plug assembly and mounting plate of the present invention.

The following description of the preferred embodiment of the present invention is merely exemplary in nature and is not intended to limit the scope of the invention as defined by the appended claims. FIG. 1 illustrates a cord set 10 including a plug assembly 12 connected to a bumper 14 of an automobile 16 such as through a mounting plate 18. The plug assembly is electrically connected to an electrically powered automobile accessory 20 such as, for example, a radiant heater, engine block heater, fluid heater, battery warmer and the like. The electrically powered automobile accessory 20 is shown in FIG. 2 to be mounted to the automobile 16 such as to an appropriate support structure on the automobile body and operationally coupled to an appropriate component of the vehicle engine 22 such as through the use of a heating element or equivalent component 24.

Plug assembly 12 electrically connects the accessory 20 to a power source 26 such as through the use of a first cord 32 and a second cord 28. Specifically, first cord 32 includes a first end 33 that is preferably permanently connected to the automobile accessory 20 and a second end having a male plug 34 mounted to mounting plate 18. Second cord 28 is preferably a standard extension cord having a first end 29 connectable to the power source and a female plug 30 engageable with male plug 34.

Figure 3:
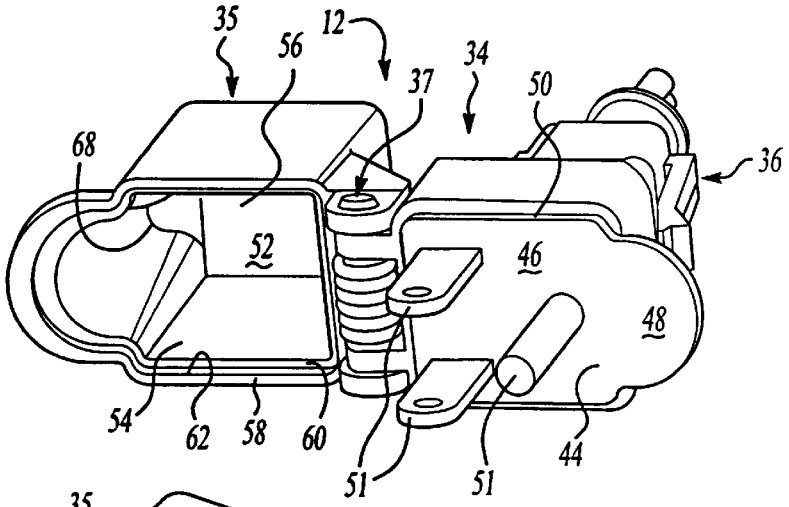
FIG. 3 is a front perspective view of the plug assembly of the present invention with the protector cap in its open position.
Figure 4:
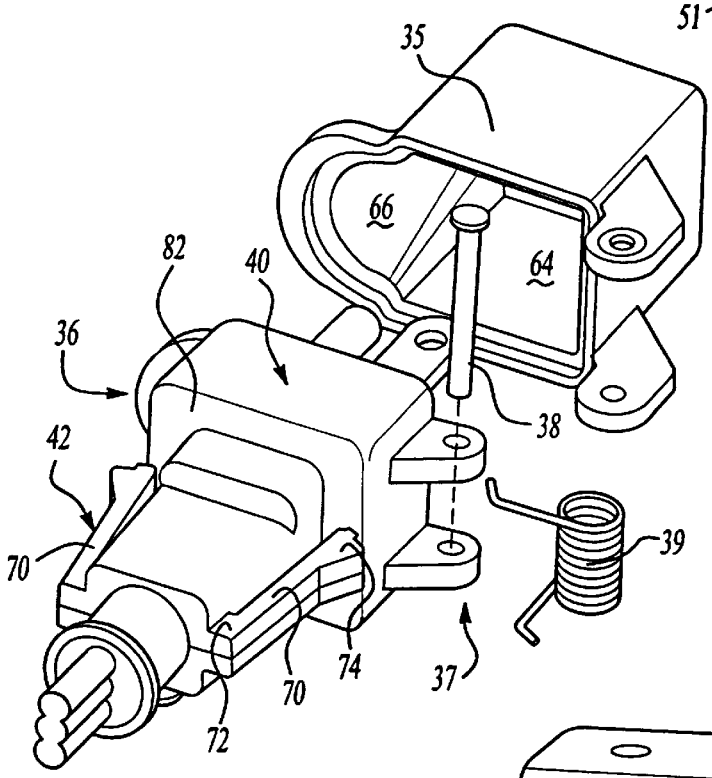
FIG. 4 is a partially exploded rear perspective view of the plug assembly.
Figure 5:
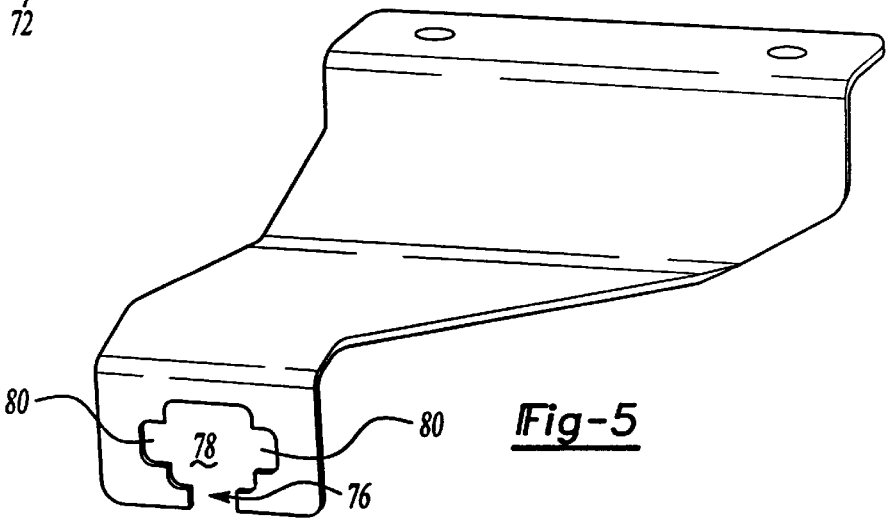
FIG. 5 is a perspective view of the mounting plate shown in FIG. 1.

As best illustrated in FIGS. 3 and 4, plug assembly 12 generally includes a protector cap 35 pivotably connected to a plug body 36 of male plug 34 such as by a hinge 37 that included a hinge pin 38 and a spring 39 that urges protector cap 35 into its closed position.

Plug body 36 includes a head 40 and a tail 42. Head 40 defines a contact surface 44 essentially comprised of a generally rectangular segment 46 and a semi-circular segment 48 projecting from rectangular segment 46 at an end thereof that is opposite hinge 37. A recess face 50 extends rearwardly from contact face 44 thereby separating contact face 44 from the remainder of head 40 to permit proper sealing of the protector cap 35 to contact face 44 as hereinafter described. Electrical contacts 51 extend outwardly from contact 44.

Protector cap 35 defines a cavity 52 extending from an open end 54 of the cavity to a closed end 56 thereof. An end face 58 of the protector cap circumscribes the open end 54 of cavity 52 and an engagement face 60 is recessed from end face 58 and interconnected therewith by a recess face 62. Open end 54 of cavity 52 is configured to cooperate with contact surface 44 of head 40. More particularly, recess face 62 of protector cap 34 is configured and sized to accommodate contact surface 44 of head 40 such that engagement face 60 of protector cap 34 engages the outer periphery of the contact surface 44 to create a seal therebetween. Those skilled in the art will appreciate from this description that the present invention provides a single recessed interface that seals the cavity 52 and protects the electrical contacts from the surrounding environment. Those skilled in the art will further appreciate from this description as well as the appended claims and drawings that the specific configuration of the seal may be modified without departing from the true spirit and fair scope of the invention as defined by the appended claims.

As is best illustrated in FIG. 4, cavity 52 generally includes a main cavity 64 communicating with a secondary cavity 66. Contacts 51 are disposed within main cavity 64 when the protector cap 34 is in its closed position relative to plug body 36 as illustrated in FIG. 2. When the protector cap 34 is moved between its closed position and its open position (FIG. 3) the contacts 51 pass through secondary cavity 66 thereby permitting unobstructed movement of the protector cap relative to the plug body. Secondary cavity 66 is preferably circular in cross-section proximate to engagement face 60 and tapers to an end face 68 (FIG. 3) proximate to closed end 56 of cavity 52. However, it should be appreciated that the illustrated configurations of the main and secondary cavities 64 and secondary 66 may be modified from that illustrated and described herein without departing from the scope of the invention defined by the appended claims. More particularly, it is contemplated that a variety of cavity configurations may be used while permitting proper sealing of the protector cap to the plug body and permitting pivotal movement of the protector cap between its fully open and closed positions.

It should further be appreciated that when the protector cap is moved into its fully opened position as illustrated in FIG. 3, the female plug 30 is freely engageable with contacts 51 and plug body 36 so as to provide free electrical connection of the automobile accessory 20 to the power source 26 without the need to maintain a secondary seal interface between the female plug and an external receptacle or housing. As discussed above, hinge 37 includes spring 39 for biasing the protector cap into its closed position upon removal of female plug 30 from engagement with contacts 51 whereupon the protector cap 34 swings into its closed position thereby sealing the cavity 52 with contacts 51 disposed therein and protected from the environment surrounding the plug and cap.

The configuration of the preferred mounting plate 18 and the arrangement for coupling the plug assembly to the mounting plate will now be described in detail with reference to FIGS. 2–6. Mounting plate 18 includes mounting openings 75 to accommodate fasteners for securing the mounting plate to the vehicle body such as at the vehicle's bumper as well as an aperture 76 (FIG. 5) having a central passage 78 flanked by a pair of opposed tab slots 80. Plug assembly 12 includes coupling tabs 70 having a first end 72 integral with tail 42 of plug body 36. Second coupling tab ends 74 are displaceable towards one another and toward tail 42 for connection of the plug body to mounting plate 18. Passage 78 is configured to accommodate tail 42 of plug body 36 whereas coupling tabs 70 are disposable within tab slots 80.

Figure 6:
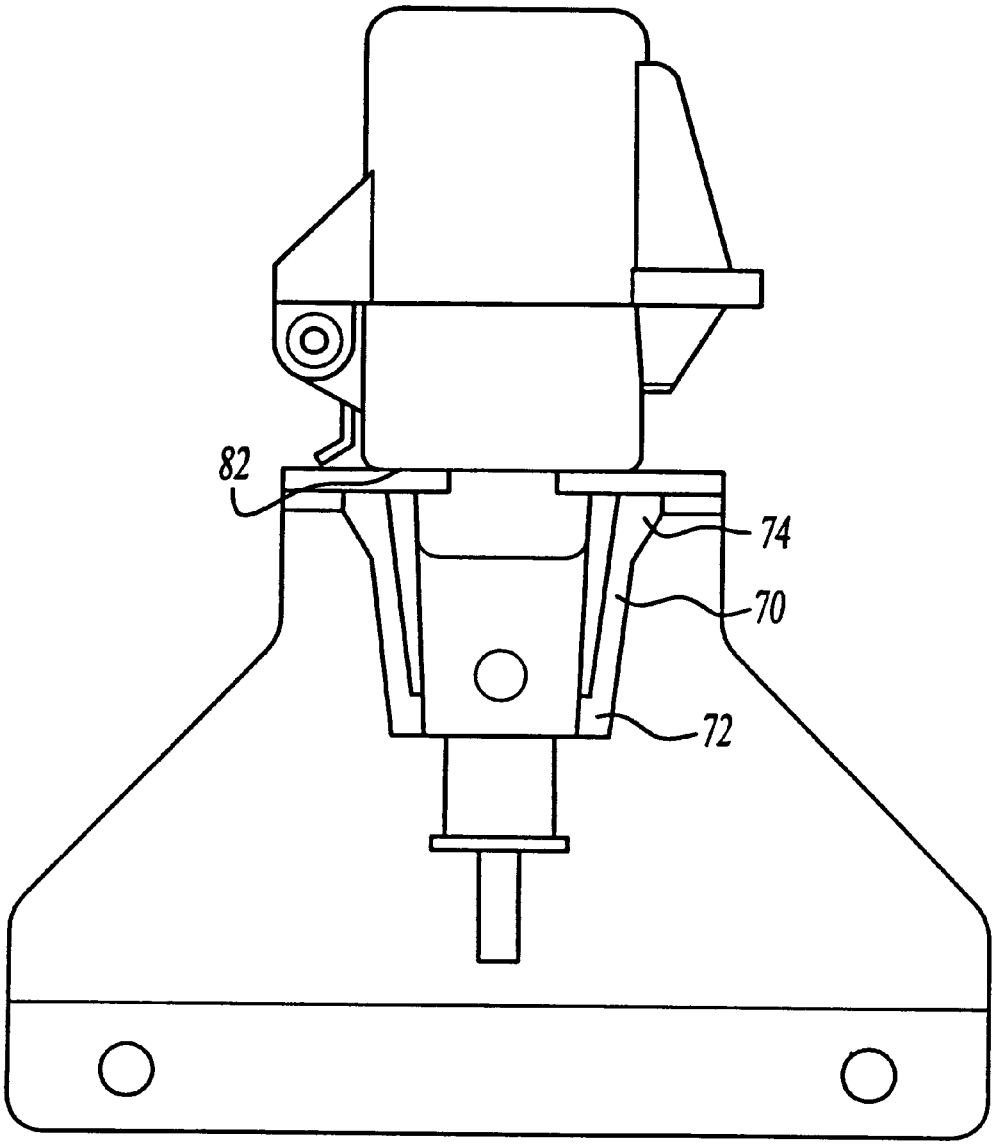
FIG. 6 is an elevational view of the plug assembly coupled to the mounting plate.

As the plug body 36 is moved into full engagement with the mounting plate 18 as shown in FIG. 6, the second coupling tab ends 74 are displaced towards one another through engagement with the portion of the mounting plate surrounding opposed tab slots 80. When tail 42 of plug body 36 is fully inserted within aperture 76, an engagement face 82 (FIG. 4) formed by plug body head 40 contacts mounting plate 18 which is further engaged on an opposite side by second coupling tab ends 74. More particularly, as best illustrated in FIG. 6 when the plug body 36 is coupled to the mounting plate 18, the mounting plate is retained between engagement face 82 of head 40 and the second ends 74 of each coupling tab 70.

It should be appreciated from the above description of the preferred embodiment to the present invention that the present invention provides a simple yet effective protector cap for a plug assembly wherein the protector cap and plug cooperate to effectively seal a cavity formed therebetween when the protector cap is in its closed position. When the protector cap is in its open position, as illustrated in FIG. 3, the plug assembly allows a standard electrical extension cord to be freely coupled to the extending contacts without obstruction. Moreover, by pivotably connecting the protector cap to the plug body the present invention eliminates the need for a receptacle housing sized to accommodate both the male and female plugs. By eliminating the use of a receptacle, the present invention reduces the sealing interfaces that must be maintained to protect the contacts from the environment to the single interface between the protector cap and the plug body. Finally, the above described mounting assembly further eliminates the need for a receptacle or housing and allows the plug to be disposed and coupled to the vehicle body within tight spaces.

The foregoing discussion discloses and describes an exemplary embodiment of the present invention. One skilled in the art will readily recognize from such discussion and from the accompanying drawings and claims, that various changes, modifications and variations can be made therein without departing from the true spirit and fair scope of the invention as defined by the following claims.

What is claimed is:

1. A plug assembly for use with an automobile accessory mounted to an automobile body, said plug assembly comprising:

a plug body having a contact surface and a recess face surrounding said contact surface;

electrical contacts coupled to said plug body and projecting from said contact surface; and a protector cap including a contact cavity extending between a closed end and an open end thereof, said protector cap having an end face located at a first plane at said open end, a cap seal surface located at a second plane surrounding said contact cavity at said open end and a recess surface extending between said end face and said cap seal surface, said protector cap coupled to said plug body for movement between a closed position and an open position, said electrical contacts and said contact surface disposed within said contact cavity, said recess surface of said protector cap surrounding said recess face of said plug body and said cap seal surface engaging said contact surface to seal said contact cavity when said protector cap is in said closed position.

2. The plug assembly of claim 1 wherein said plug further includes a hinge coupled to a first side of said plug body and a first side of said protector cap such that said hinge pivotably connects said protector cap to said plug body.

3. The plug assembly of claim 2 wherein said hinge includes a spring urging said protector cap toward its closed position.

4. The plug assembly of claim 2 wherein said contact cavity includes a main cavity and a secondary cavity communicating with said main cavity, said main cavity accommodating said contacts when said protector cap is in said closed position, said electrical contacts passing through said secondary cavity when said protector cap is moved between its open and closed positions.

5. The plug assembly of claim 4 wherein said contact surface includes a generally rectangular segment extending from said first side of said plug body and a second segment projecting from said generally rectangular segment opposite said first side of said plug body.

6. The plug assembly of claim 5 wherein said main cavity is generally rectangular in cross-section at said open end of said protector cap and extends from said first side of said protector cap, said secondary cavity projecting from said generally rectangular portion of said main cavity opposite said first side of said protector cap, said cap seal surface being continuous about said main and secondary cavities at said open end of said protector cap.

7. The plug assembly of claim 1 further including a mounting assembly adapted to couple the plug body to the automobile body, said mounting assembly including a mounting bracket adapted to be connected to the automobile body and having an aperture, said mounting assembly further including a coupling tab having a first end integral with said plug body and a second end movable between an engaged position wherein said coupling tab engages said mounting bracket to couple said plug body to said mounting bracket and a retracted position wherein said plug body is movable relative to said mounting bracket.

8. The plug assembly of claim 7 wherein said plug body further includes a head integral with a tail, said head defining an engagement face and said contact surface, said tail extending from said engagement face of said head, and wherein said first end of said coupling tab is integral with said tail and said coupling tab extends toward said head.

9. The plug assembly of claim 8 wherein said mounting bracket is retained between said engagement face and said second end of said coupling tab.

10. A cord set for an electrically powered automobile accessory coupled to a vehicle, wherein the cord set includes a cord having a first end electrically connected to the electrically powered automobile accessory, a second end having a plug with male electrical contacts extending from a contact surface of the plug, the cord set further including a mounting mechanism for coupling the plug to the vehicle, wherein the improvement comprises:

a protector cap pivotably coupled to said plug for movement between an open position and a closed position, said protector cap defining a cavity about said male electrical contacts when the cap is in its closed position, said protector cap including an end face located at a first plane, an engagement face located at a second plane and a recess surface extending therebetween, said engagement face engaging said contact surface of said plug when said protector cap is in said closed position to define a seal between said engagement face and said contact surface.

11. The cord set of claim 10 further including a hinge pivotably connecting said cap to a first side of said plug.

12. The cord set of claim 10 wherein the mounting mechanism includes a mounting bracket adapted to be connected to the vehicle and having an aperture, said mounting mechanism further including a coupling tab having a first end integral with the plug and a second end movable between an engaged position wherein said coupling tab engages the mounting bracket to couple the plug to the mounting bracket and a retracted position wherein the plug is movable relative to the mounting bracket.

* * * * *